US006046725A

United States Patent [19]

Yoon

[11] Patent Number: 6,046,725

[45] Date of Patent: Apr. 4, 2000

[54] MULTICOLOR DISPLAY CONTROL METHOD FOR LIQUID CRYSTAL DISPLAY

[75] Inventor: Hee Gyung Yoon, Seoul, Rep. of Korea

[73] Assignee: LG Electronics Inc., Seoul, Rep. of Korea

[21] Appl. No.: 08/989,520

[22] Filed: Dec. 12, 1997

[30] Foreign Application Priority Data

Jan. 24, 1997 [KR] Rep. of Korea ..... 97-2067

[51] Int. Cl.[7] ..... G09G 3/36

[52] U.S. Cl. ..... 345/155; 345/88; 345/213

[58] Field of Search ..... 345/89, 87, 88, 345/98, 99, 100, 147, 148, 150, 153, 155, 211, 204, 213

[56] References Cited

U.S. PATENT DOCUMENTS 5,677,704 10/1997 Kusaro et al. ..... 345/89

5,818,419 10/1998 Tajima et al. ..... 345/147

*Primary Examiner*—Xiao Wu

*Attorney, Agent, or Firm*—Morgan, Lewis & Bockius LLP

[57] ABSTRACT

A dither circuit for reproducing multicolor data includes a latch for receiving 8 input data bits and a clock signal, and for separating the 8 input data bits into high 7 bits and a low bit; a frame rate generator for receiving a horizontal sync signal, a vertical sync signal and a clock signal, and for generating a frame rate bit, wherein the frame rate bit is toggled according to each cycle of the vertical sync signal; a frame rate controller for receiving the low bit from the latch and the frame rate bit from the frame rate generator, and generating a frame data; and an adder for receiving the frame data from the frame rate controller and the high 7 bits from the latch, and for generating 7 output data bits.

16 Claims, 3 Drawing Sheets

MULTICOLOR DISPLAY CONTROL METHOD FOR LIQUID CRYSTAL DISPLAY

This application claims the benefit of Korean Application No. P97-02067, filed on Jan. 24, 1997, which is hereby incorporated by reference.

BACKGROUND OF THE INVENTION

1. Field of the Invention

The present invention relates to a dither method, and more particularly, to a dither method for converting color display information into pixel information of a flat panel display, such as a liquid crystal display device. In addition, the present invention relates to a circuit for a dither method that uses fewer color levels to display more colors.

2. Description of the Related Art

A cathode ray tube (CRT) is the most general display device. A CRT reproduces color display information by using electron guns for a red color, a green color and a blue color. As the display screen size becomes larger, the thickness of the CRT also must be thicker, since a certain distance between the electron guns and the screen of the CRT is required in order for the CRT device to reproduce the images. As a result, the CRT is no longer a proper display device when the small private display device, such as TV, is replaced with the large public device, such as a beam projector.

In recent years, many flat display devices have been developed as alternatives to the CRT. Among them, a liquid crystal display (LCD) device has become more popular than others. Conventionally, an LCD comprises, as shown in FIG. 1, a controller IC 10, a scan line driver IC 12, a signal line driver IC 11 and an array of thin film transistors (TFT) 11. A plurality of scan lines 16 are connected to the scan line driver IC 12. A plurality of signal lines 15 are connected to the signal line driver IC 11. At the intersection area of the scan lines 16 and the signal lines 15, the thin film transistors 13 connecting with pixel electrodes 14 are formed in an array. Gate electrodes of the thin film transistors 13 are connected to the scan lines 16, source electrodes thereof are connected to the signal lines 15, and drain electrodes thereof are connected to the pixel electrodes 14. When a certain voltage is applied to the gate electrodes of the TFT 13, the source electrodes of the TFT 13 and the drain electrodes are electrically connected. If there is no voltage at the gate electrodes, the source and the drain electrodes are electrically isolated.

The conventional method for reproducing the image information in the LCD device will now be described. The image information is converted into a signal voltage at the controller IC 10 and the signal voltage is held at the signal line driver IC 11. The signal line driver IC 11 sends the signal voltage to the signal lines 15 according to the scan signal. For example, when the scan line driver IC 12 sends the scan voltage to the first scan line 16 according to a predetermined frequency signal, the TFTs 13 connected to the first scan line 16 are turned on and the signal voltages corresponding to the first line of the image information are applied to the first line of the pixel electrodes 14 in the array. When the scan line driver IC 12 sends the scan voltage to the second scan line 16, the signal voltages corresponding to the second line of the image information from the signal line driver IC 11 are applied to the second line of the pixel electrodes 14. Similarly, the signal voltages corresponding to other lines of the image information are applied to the remaining pixel electrodes 14 in the array. As a result, the image information is reproduced at the screen of the LCD.

In order to reproduce the image information having colors, the image information is divided into color information comprising red (R), green (G) and blue (B) colors. These color elements (R, G and B) are joined together at each pixel of the LCD screen.

The conventional method for reproducing the color information in an LCD device will now be described. FIG. 2 shows the structure of a conventional controller IC in the color LCD devices. The conventional controller IC comprises a read only memory (ROM) table 21 having color data bits that are sent to the signal lines according to a horizontal sync signal ($H_s$) and a vertical sync signal ($V_s$). In addition, a latch 22 gets an input image data according to a clock signal (CK) and sends an address signal to the ROM table 21. A frame rate controller (FRC) 20 sends a signal for determining a dot position and a frame page of the color data from the ROM table 21.

As shown in FIG. 2, the input color data including L bits from a video processing unit, such as a VGA card, are sent to the latch 22 according to the clock signal (CK). At the latch 22, the input color data are translated to address bits representing the address of the color data in the ROM table 21. The FRC 20 determines the scan line to which the dot belongs according to the horizontal sync signal ($H_s$), and determines the frame page of the color data according to the vertical sync signal ($V_s$). That is, the input color data is used to generate the address data of the ROM table 21 having the output color data. The output color data from the ROM table 21 is applied to the signal line driver IC. The output color data determines the voltage level for driving the liquid crystal. As a result, the color image is reproduced at the LCD screen according to the driving voltage level of the liquid crystal.

Here, the number of colors is determined by the bit number of the output color data. If the bit number L is 3, then the color dots, R, G and B, have 3 bit color level. As a result, the color number of one pixel is $2^9$. That is, 512 colors can be reproduced at the same time. The so-called "true color" is that the color dots, R, G and B, have the 8 bit color levels, so that the number of colors in one pixel is $2^{24}$(=16,777,216). The display for the true color can reproduce the 16.7 Mega colors at the same time.

In the controller IC, the number of bits of the input color data is 8 bits when the input color data is the true color. However, the output color data is not 8 bits. Because the driver IC for 8 bits is very expensive, the total price of an LCD is too expensive if driver IC for 8 bits is used. Generally, the price of the driver IC for 3 bits or 6 bits is from \$5 to \$9, and that of the 8 bits is from \$25 to \$40. Furthermore, if the output data bus line is 8 bits, the method for manufacturing the LCD panel is more complicated than using data bus line with less than 8 bits. Consequently, there are many research and development efforts for reproducing the true color using less than 8 bits.

In addition, in the conventional controller IC, a ROM table is used for reproducing the color information. The ROM table is also very expensive. Even though the output color data is to be 6 bits, the frames for reproducing the true color must have different color levels. As a result, the ROM table is indispensable. This leads to the high cost for manufacturing the LCD.

Accordingly, many difficulties arise with the conventional LCD device when attempting to display colors with a very high resolution. In order to increase the number of displaying colors, the data bits for representing the color must be increased and the lining structure for the color data lines is, in turn, more complicated. As a result of having more color data bits, it becomes more expensive to manufacture the LCD.

SUMMARY OF THE INVENTION

Accordingly, the present invention is directed to a multicolor display control method for an LCD that substantially obviates one or more of the problems due to limitations and disadvantages of the related art.

An object of the present invention is to provide a method for manufacturing the LCD driving circuit for reproducing the true color using less bits than the input color data bits (8 bits), and not using the ROM as the memory color table.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the invention, as embodied and broadly described, a dither circuit for reproducing multicolor data includes, as shown FIG. 3, a latch 103 having input terminals and dividing the input color information having L bits to high bits having M bits and low bits having (L−M) bits, respectively; a frame rate generator 100 outputting frame rate bits having (L−M) bits by inputting a horizontal sync signal ($H_s$) and a vertical sync signal ($V_s$) and a clock signal (CK); a frame rate controller 101 outputting a frame data (FD) bit by the low (L−M) bits and the frame rate bits; and an adder 132 generating output color information having M bits by adding the high M bits and the frame rate data (FD) bit.

According to another aspect of the invention, a dither circuit for reproducing multicolor data includes a latch for receiving L input data bits and a clock signal, and for dividing the L input data bits into high L−1 bits and a low bit; a frame rate generator for receiving a horizontal sync signal, a vertical sync signal and a clock signal, and for generating a frame rate bit, wherein the frame rate bit is toggled according to each cycle of the vertical sync signal; a frame rate controller for receiving the low bit from the latch and the frame rate bit from the frame rate generator, and for generating a frame data; and an adder for receiving the frame data from the frame rate controller and the high L−1 bits from the latch, and for generating L−1 output data bits.

Still another aspect of the present invention is the method for reproducing a dithered multicolor including the steps of: dividing an input data having 8 bits of color information corresponding to a pixel into two frames each including a modified data having 7 bits, wherein the two frames are distinguished by a vertical sync signal; and applying the modified data having 7 bits to the pixel at each frame.

A dither processing of the present invention is described below. As shown in FIG. 3, the input color information of one pixel having L bits is input to the latch 103. The L bits divided to high M bits and low (L−M) bits. On the other hand, in the frame rate generator 100, frame rate bits are generated by logical operation using the horizontal sync ($H_s$) signal and the vertical sync ($V_s$) signal. The frame rate controller 101 generates a frame data by a logical operation using the low (L−M) bits and the frame rate bits. And the frame rate bit is added to the high M bits, finally the complemented output color information is generated. The present invention reproduces the color information by converting the original color information having L bits to the pseudo color information having M bits, which is less than L bits. The color image data is divided into (L−M) frames and one frame wherein the complemented color is represented according to the value of the frame data. Referring to the preferred embodiments, we will explain the present invention more precisely.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION OF THE PREFERRED EMBODIMENTS

Reference will now be made in detail to the preferred embodiments of the present invention, examples of which are illustrated in the accompanying drawings.

Figure 1:
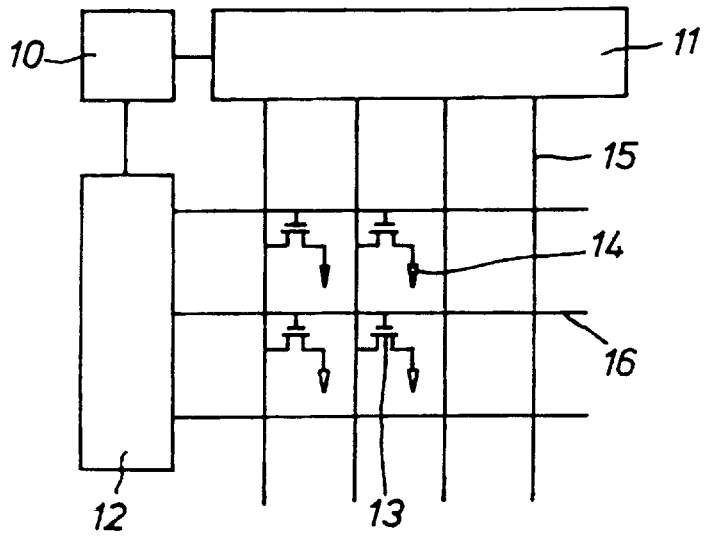
Fig. 1 Conventional Art
FIG. 1 is a diagram illustrating a conventional LCD.
Figure 2:
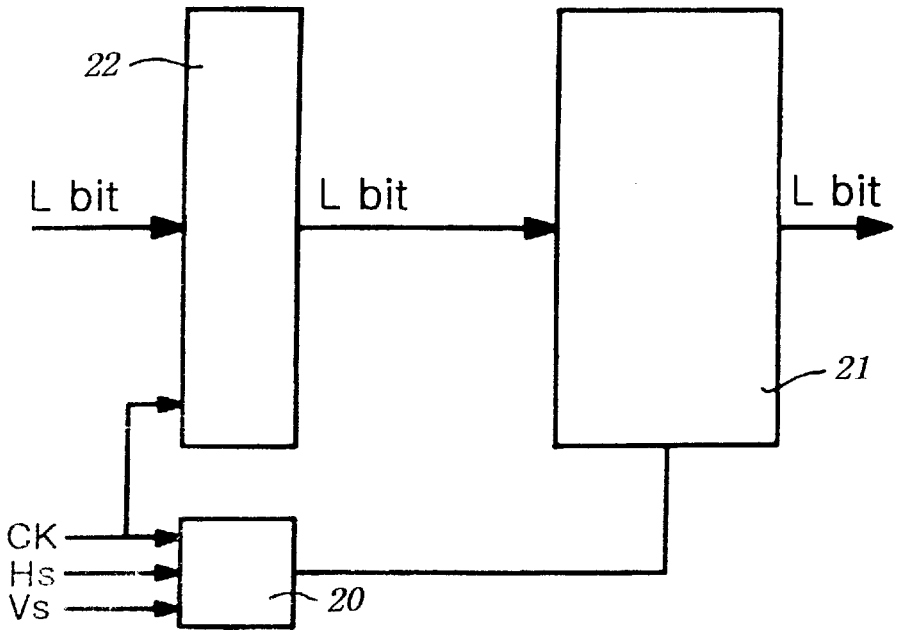
Fig. 2 Conventional Art
FIG. 2 is a diagram illustrating the structure of a conventional controller IC of a color.LCD.
Figure 3:
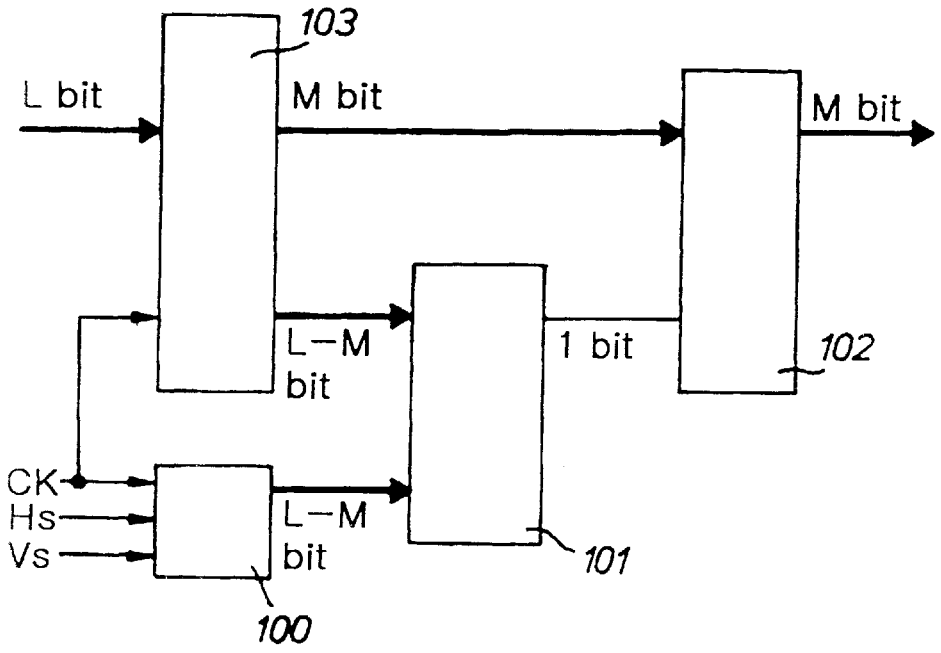
FIG. 3 is a diagram illustrating the structure of a dithering controller IC for the LCD of the present invention.

FIG. 3 is a diagram illustrating the structure of a dithering controller IC for the LCD of the present invention. The dithering controller IC of the present invention includes a latch 103 for dividing an input color data of L bits into high M bits and low L−M bits. A frame rate generator 100 generates frame timing bits (L−M bits) by using a vertical sync signal ($V_s$). A frame rate controller 101 generates a frame data by using the frame timing bits from the frame rate generator 100 and the low L−M bits from the latch 103. An adder 102 generates the output color data by adding the high M bits from the latch 103 and the frame data from the frame rate controller 101.

Figure 4:
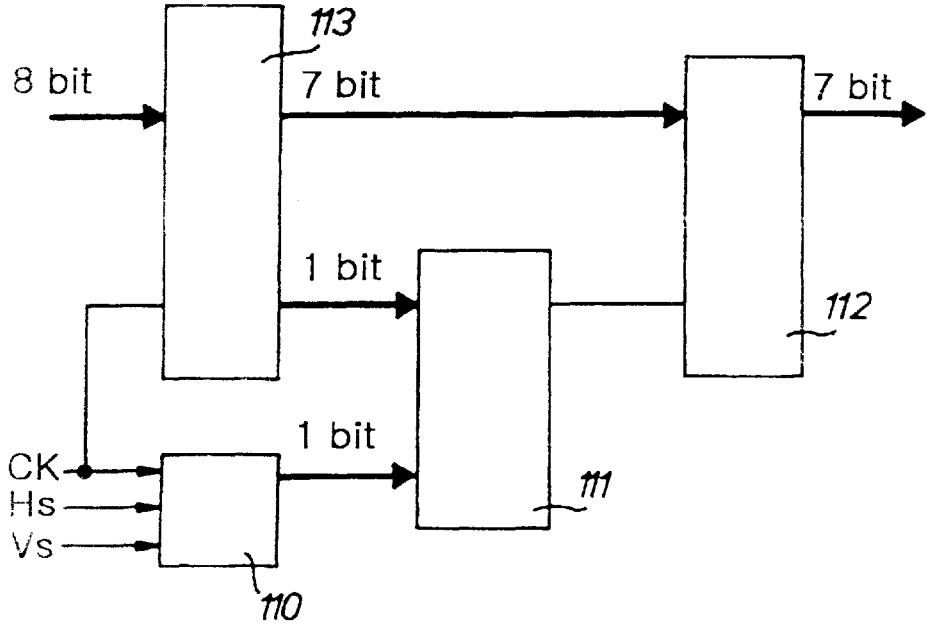
FIG. 4 is an example of reproducing a color data having 8 bits using an output color data having 7 bits according to the present invention.

FIG. 4 is an example of producing a color data having 8 bits using an output color data having 7 bits according to the present invention. In this preferred embodiment, the input color information comprising 8 bits is reproduced as pseudo color information by combining two frames comprising dithered 7 bits colors. FIG. 4 shows the structure of a dithering controller IC wherein the input color data comprising 8 bits is converted to the output color data comprising 7 bits. In order to reproduce the same color level of the input color, the present invention uses two frames each having 7 bits color level, and then combines the two frames according to the horizontal sync signal and the vertical sync signal.

Figure 5:
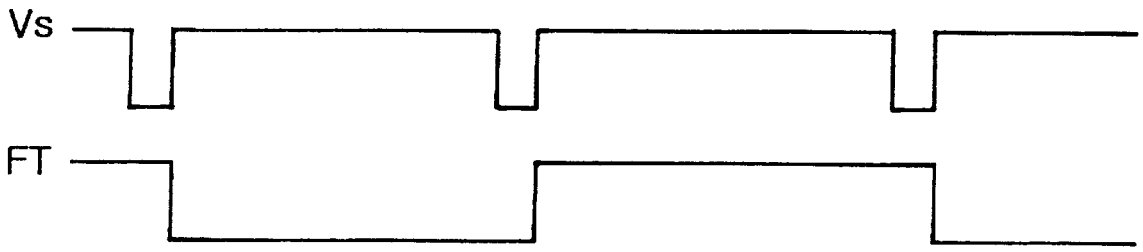
FIG. 5 is a waveform of a frame timing signal from a frame rate controller (FRC) according to the present invention.

Referring to FIG. 4, a latch 113 divides the input color data comprising 8 bits into high 7 bits and a low bit. A frame rate generator 110 generates a frame timing (FT) bit (also called the frame rate bit) using a vertical sync signal ($V_s$). FIG. 5 shows the FT signal shape with a reversed phase to that of the vertical sync signal ($V_s$) and the FT signal is toggled according to each cycle of the vertical sync signal ($V_s$). A frame rate controller (FRC) 111 generates a frame data (FD) by a logical AND operation using the FT bit from the frame rate generator 110 and the low bit from the latch 113. An adder 112 generates the output color data by adding the high 7 bits and the FD bit. Here, the FT signal determines the frame number in which the output color data is applied. If the FT signal is 0, then the $0^{th}$ frame is selected. If the FT signal is 1, then the $1^{st}$ frame is selected. Therefore, the combined color of the $0^{th}$ and $1^{st}$ frame is represented through the LCD panel. The true-false table for the FD signal according to the low bit and the FT signal is shown in Table. 1.

TABLE 1

The True-False table for the FD signal according to the low bit and the FT signal.

| The low bit | FT signal bit | FD bit |
|---|---|---|
| 0 | 0 | 0 |
| 0 | 1 | 0 |
| 1 | 0 | 0 |
| 1 | 1 | 1 |

For example, we assume that the input color data is 00100001 comprising 8 bits. The latch 113 divides the 8 bits into high 7 bits, 0010000, and a low bit, 1. When the FT signal is 0, the FD bit is 0. So, the output color data to the frame 0 is 0010000, the logical OR of high 7 bits and the FD bit. When the FT signal becomes 1 in the next signal, the FD bit is 1. So, the output color data to the frame 1 is 0010001, the logical OR of high 7 bits and the FD bit. Consequently, the output color data 0010000 and 0010001 are applied to the same pixel. Then, the middle color level between 0010000 and 0010001 is reproduced at the pixel.

In another case, we assume that the input color data is 00100000 comprising 8 bits. The latch 113 also divides the 8 bits into high 7 bits, 0010000, and a low bit, 0. When the FT signal is 0, the FD bit is 0, according to Table 1. So, the output color data to the frame 0 is 0010000, the logical OR of high 7 bits and the FD bit. Next, when the FT signal is 1, the FD bit is 0. So, the output color data to the frame 1 is 0010000, the same as the frame 0. Therefore, the output color data 0010000 is applied to one pixel twice. As a result, the represented color of the pixel is the same value as the input color.

If the result bits become 8 bits as a result of the adding operation, the adding operation is not to be Performed. For example, when the high 7 bits are 1111111 and the FD bit is 1, the added value is 10000000. In this case, the output data is not a proper value, 0000000. Thus, when the 7 bits of the input data are all "1"s, the adding value must be corrected. One method for correction is to reset by decreasing 1 bit. Another method is to detect when the 7 bits of the input data are all "1"s, and to bypass the adding operation.

Figure 6:
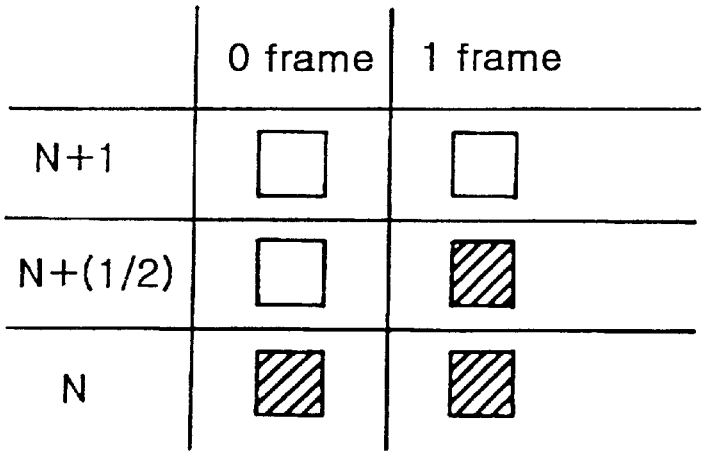
FIG. 6 is a table illustrating a method for reproducing a middle color tone using two frames having different color tones comprising 7 bits.

According to the present invention, the represented color is determined by the combined color of frames 0 and 1. The applied color data for each frame is determined by the low bit. That is, the pseudo color comprising the 7 bits with 128 color levels can reproduce the input color comprising the 8 bits with 256 color levels. In order to reproduce the $255^{th}$ color, the $127^{th}$ color is applied to the frames 0 and 1. In order to reproduce the $254^{th}$ color, the $126^{th}$ color is applied to the frame 0 and the $127^{th}$ color is applied to the frame 1. FIG. 6 shows the applied color to the frames of a pixel, when the middle color between $N^{th}$ and $(N+1)^{th}$ is $(N+½)^{th}$.

We have mentioned that the input color comprises 8 bits. For the true color, the red, green and blue colors each comprises 8 bits. Thus, the pseudo color comprising 21 bits of RGB can reproduce the true color comprising 24 bits of RGB.

Accordingly, circuits of the present invention can reduce the output color bits, so that the processing lining representing colors is simplified. In addition, the cost for manufacturing the LCD is reduced by using the controller IC with a lower price.

Furthermore, even though the frame numbers per second in the present invention are less than the conventional art because of the two frames used for dithering, this can be easily overcome by speeding up the horizontal and vertical sync signals.

It will be apparent to those skilled in the art that various modifications and variations can be made in the multicolor display control method of the present invention without departing from the spirit or scope of the invention. Thus, it is intended that the present invention cover the modifications and variations of this invention provided they come within the scope of the appended claims and their equivalents.

What is claimed is:

1. A dither circuit for reproducing multicolor data comprising:

a latch for receiving 8 input data bits representing all R, G, B color information and a clock signal, and for separating the 8 input data bits into high 7 bits and a low bit;

a frame rate generator for receiving a horizontal sync signal, a vertical sync signal and a clock signal, and for generating a frame rate bit, wherein the frame rate bit is toggled according to each cycle of the vertical sync signal;

a frame rate controller for receiving the low bit from the latch and the frame rate bit from the frame rate generator, and for generating a frame data; and an adder for receiving the frame data from the frame rate controller and the high 7 bits from the latch, and for generating 7 output data bits.

2. The circuit according to claim 1, wherein the 8 input data bits include 8 color data bits of a video signal.

3. The circuit according to claim 1, wherein the frame rate controller includes an AND circuit.

4. The circuit according to claim 1, wherein the adder includes a detector for detecting when the high 7 bits are all "1"s.

5. The circuit according to claim 1, wherein the adder includes an AND circuit for adding the high 7 bits and the frame data to generate the 7 output data bits.

6. The circuit according to claim 1, wherein the latch includes a detector for detecting when the high 7 bits are all "1"s.

7. A dither circuit for reproducing multi-color data comprising:

a latch for receiving L input data bits and a clock signal, and for dividing the L input data bits into high L−1 bits and a low bit;

a frame rate generator for receiving a horizontal sync signal, a vertical sync signal and a clock signal, and for generating a frame rate bit, wherein the frame rate bit is toggled according to each cycle of the vertical sync signal;

a frame rate controller for receiving the low bit from the latch and the frame rate bit from the frame rate generator, and for generating a frame data; and an adder for receiving the frame data from the frame rate controller and the high L−1 bits from the latch, and for generating L−1 output data bits.

8. The circuit according to claim 7, wherein the L input data bits include L color data bits of a video signal.

9. The circuit according to claim 7, wherein the frame rate controller includes an AND circuit.

10. The circuit according to claim 7, wherein the adder includes a detector for detecting when the high L−1 bits are all "1"s.

11. The circuit according to claim 7, wherein the adder includes a detector for detecting when the high L−1 bits are all "1"s and for decreasing the L−1 output data bits by 1 bit.

12. The circuit according to claim 10, wherein the adder includes an AND circuit for adding the high L−1 bits and the frame data to generate the L−1 output data bits.

13. The circuit according to claim 7, wherein the latch includes a detector for detecting when the high L−1 bits are all "1"s.

14. A method for reproducing a dithered multicolor, comprising the steps of:

dividing an input data having representing all R, G, B color information corresponding to a pixel into two frames each including a modified data having 7 bits, wherein the two frames are distinguished by a vertical sync signal; and applying the modified data having 7 bits to the pixel at each frame.

15. A method for reproducing a dithered multicolor, comprising the steps of:

dividing an input data having L bits representing all R, G, B color information corresponding to a pixel into 2 frames each including a modified data having (L−M) bits, wherein the two frames are distinguished by a vertical sync signal; and applying the modified data having (L−M) bits to the pixel at each frame, wherein the all R, G, B color information is simultaneously processed.

16. The method according to claim 15, wherein L is greater than M.

* * * * *

UNITED STATES PATENT AND TRADEMARK OFFICE

CERTIFICATE OF CORRECTION

PATENT NO. : 6,046,725
DATED : April 4, 2000
INVENTOR(S) : Hee Gyung Yoon

It is certified that error appears in the above-identified patent and that said Letters Patent is hereby corrected as shown below:

Column 8, line 3, after "having" insert --8 bits --.

Signed and Sealed this

Fifth Day of June, 2001

Nicholas P. Godici

NICHOLAS P. GODICI

*Acting Director of the United States Patent and Trademark Office*

*Attest:*

*Attesting Officer*